US006796737B2

(12) United States Patent
Ashe

(10) Patent No.: US 6,796,737 B2
(45) Date of Patent: Sep. 28, 2004

(54) DISPOSABLE SINGLE-USE APPLICATOR WITH CLOSURE CAP

(75) Inventor: Gary Ashe, Sanborn, NY (US)

(73) Assignee: TMP Technologies, Inc., Buffalo, NY (US)

( * ) Notice: Subject to any disclaimer, the term of this patent is extended or adjusted under 35 U.S.C. 154(b) by 0 days.

(21) Appl. No.: 10/650,472

(22) Filed: Aug. 28, 2003

(65) Prior Publication Data

US 2004/0126178 A1 Jul. 1, 2004

Related U.S. Application Data

(60) Provisional application No. 60/406,523, filed on Aug. 28, 2002.

(51) Int. Cl.[7] ..... B43K 5/00

(52) U.S. Cl. ..... 401/202; 401/183; 401/265; 401/266; 215/256

(58) Field of Search ..... 401/183, 196, 401/202, 245, 262, 265, 266, 282, 284; 215/256, 251, 258; 220/255, 256

(56) References Cited

U.S. PATENT DOCUMENTS

| | | | | |
|---|---|---|---|---|
| 3,072,953 A | | 1/1963 | Bunke | 15/592 |
| 3,135,007 A | | 6/1964 | Howell | 15/608 |
| 3,756,732 A | | 9/1973 | Stoffler | 401/202 |
| 3,797,946 A | | 3/1974 | Witzmann et al. | 401/116 |
| 4,780,017 A | | 10/1988 | Bradford | 401/186 |
| 4,887,924 A | | 12/1989 | Green | 401/261 |
| 5,110,017 A | * | 5/1992 | Braun | 215/256 |
| 5,577,851 A | | 11/1996 | Koptis | 401/202 |
| 6,244,773 B1 | | 6/2001 | Geremia-Nargi | 401/195 |
| 6,332,550 B1 | * | 12/2001 | Bennett et al. | 215/256 |

* cited by examiner

*Primary Examiner*—Tuan N. Nguyen
(74) *Attorney, Agent, or Firm*—Walter W. Duft

(57) ABSTRACT

An applicator and closure cap assembly includes a container adapted to carry a fluid therein and which is formed with a neck portion. A porous applicator tip is secured to the container. An orifice provides a fluid pathway from a fluid holding portion of the container to the applicator tip. A closure cap is slidably disposed in non-locking interfacial engagement with the container's neck so as to cover the applicator tip. A removable seal is provided to secure the closure cap to the neck and to seal the cap-container interface prior to use.

25 Claims, 4 Drawing Sheets

DISPOSABLE SINGLE-USE APPLICATOR WITH CLOSURE CAP

CROSS REFERENCE TO RELATED APPLICATIONS

This application claims the benefit under 35 U.S.C. 119(e) of U.S. Provisional Patent Application Ser. No. 60/406,523, filed on Aug. 28, 2002, entitled "Disposable Single-Use Applicator With Orifice Closure Cap."

BACKGROUND OF THE INVENTION

1. Field of the Invention

The present invention relates to applicators for applying fluids to a surface, and particularly to disposable applicators for applying fluid material on a single-use basis.

2. Description of the Prior Art

By way of background, various applicators for dispensing fluid material have been proposed in the prior art. According to one design approach, an applicator includes a container that is filled with a fluid to be dispensed. A porous applicator tip is mounted over an opening at one end of the container for applying the fluid. The applicator tip has a central bore that provides a direct pathway for delivery of the fluid from the container. A cap is designed to lockingly engage the container, typically by way of a threaded connection comprising mating threads respectively formed on an inner wall of the cap and an outer wall of the container. The cap may have an interior pin adapted to plug the bore in the applicator tip when the applicator is not in use. The cap thus seals the fluid in the container against contact with the outside environment between each use of the applicator.

It is to improving applicators of the foregoing type that the present invention is directed. In particular, a low cost disposable applicator that is optimized for single use only is needed.

SUMMARY OF THE INVENTION

The foregoing problems are solved and an advance in the art is provided by an applicator and closure cap assembly. The assembly includes a container that is adapted to carry a fluid therein and formed with a neck. A porous applicator tip is secured to the container. An orifice provides a fluid pathway from a fluid holding portion of the container to the applicator tip. A closure cap is slidably disposed in non-locking interfacial engagement with the neck so as to cover the applicator tip. A removable seal is provided to secure the closure cap to the neck and to seal the cap-container interface prior to use.

BRIEF DESCRIPTION OF THE DRAWING

The foregoing and other features and advantages of the invention will be apparent from the following more particular description of preferred embodiments of the invention, as illustrated in the accompanying Drawing in which.

DETAILED DESCRIPTION OF PREFERRED EMBODIMENTS

Figure 1:
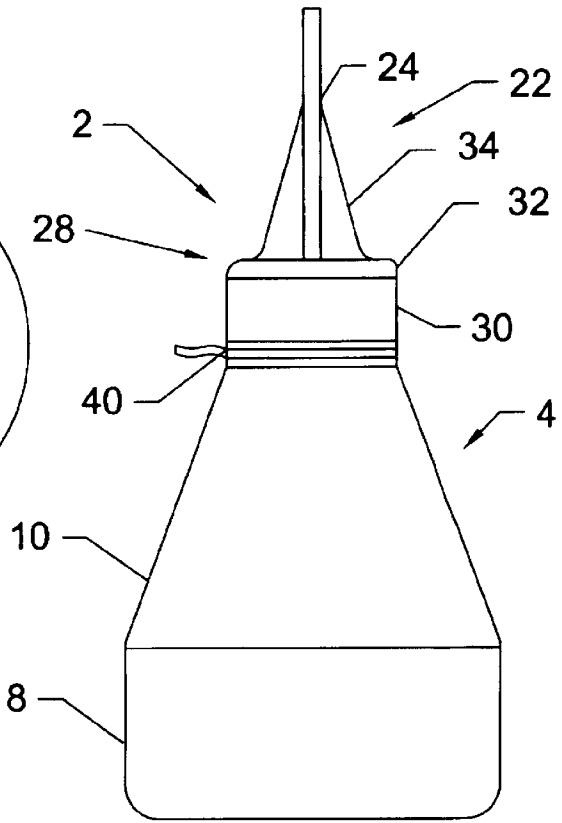
FIG. 1 is a side elevational view showing an applicator and closure cap assembly in accordance with a first embodiment of the invention in which the applicator is charged with a fluid and fully sealed for subsequent use.
Figure 3:
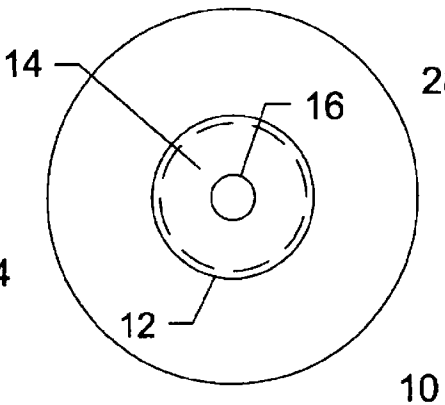
FIG. 3 is a cross-sectional view taken along line 3—3 in FIG. 2.
Figure 2:
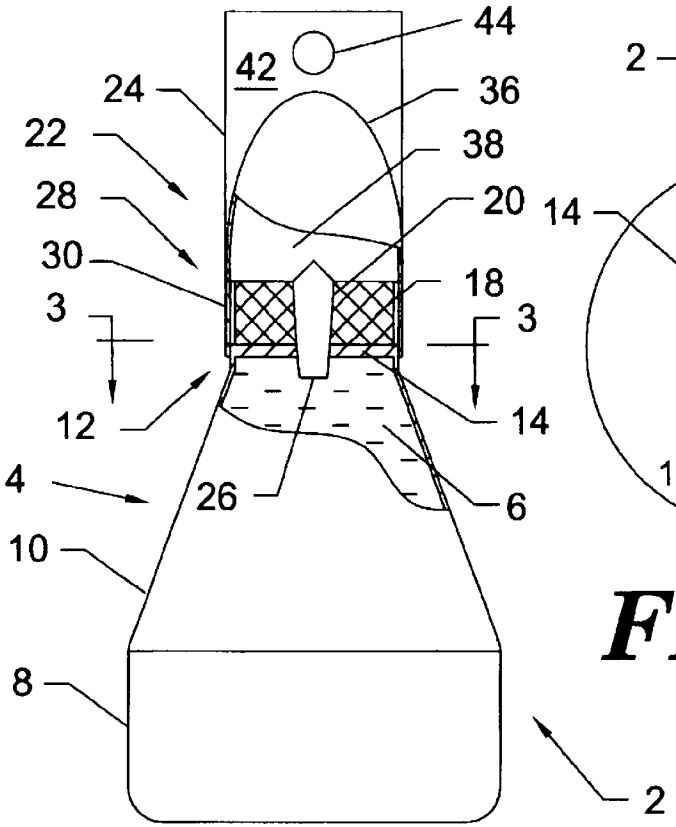
FIG. 2 is a front elevational view showing the assembly of FIG. 1 with a portion thereof broken away for clarity.

Turning now to the figures, wherein like reference numerals represent like elements in all of the several views, FIGS. 1–3 illustrate a disposable single-use applicator 2 constructed in accordance with a first embodiment of the invention. The applicator 2 comprises a container 4 that contains a fluid 6 to be dispensed. It will be seen that the container 4 has a fluid holding body portion formed by a lower cylindrical-walled section 8 and an upper frustoconical-walled section 10 that tapers inwardly from the cylindrical-walled section. This configuration is exemplary only and it should be understood that the container 4 can be constructed according to any desired shape and size. The container 4, moreover, can have any desired rigidity depending on whether it is to squeezable (non-rigid) or non-squeezable (rigid), and can be made from any suitable material that is impervious to the fluid 6 and has the desired rigidity. Exemplary materials include molded plastic, glass, metal, etc. When the container 4 has a configuration such as that shown in FIGS. 1–3, it will normally be designed to have medium to high rigidity. Medium rigidity would be provided by molding the container 4 from a material such as moderately flexible plastic (so as to be somewhat squeezable). High rigidity would be provided by forming the container 4 from hard plastic, glass or metal (so as to be non-squeezable). Although not shown, if a very low rigidity container is desired, an alternative container design could be used, such as a flexible pouch made from soft plastic (e.g., like a toothpaste tube) or the like. Many other alternative constructions would also be possible.

The fluid 6 can be for any purpose including medical applications (e.g., wound treatment, etc.), business applications (e.g., typographic correction, etc.), or industrial applications (e.g., lubrication, etc.). Perhaps the only limitation on the fluid 6 is that it be compatible with the materials used to construct the applicator 2, and that its viscosity not be so high that it cannot be dispensed from the applicator under normal use conditions.

The top of the container 4 is formed with a neck portion 12 that is shown in FIG. 2 to comprise a short section having non-tapered cylindrical side walls extending from the frustoconical-walled section 10. Note, however, that the neck portion 12 need not be limited to any particular shape or size so long as it is capable of supporting a closure cap, as described in more detail below. For example, the cylindrical neck structure of FIG. 2 could be removed and the neck portion 12 could be provided in whole or in part by the top of the container's frustoconical-walled section 10. In that case, the neck portion 12 would include tapered side walls.

A wall 14 or other structure of suitable configuration extends across the opening formed by the neck portion 12 and provides an upper barrier to the fluid 6 within the container 4. A central fluid delivery orifice 16 in the wall 14 provides a fluid pathway from the fluid holding portion of the container 4 to a generally cylindrical applicator tip 18. The applicator tip 18 can be conveniently secured to the container 4 by laminating or otherwise attaching it to the top of the wall 14. Other configurations for securing the applicator tip 22 to the container 4, which might include the use of additional mounting components (not shown), could likewise be employed. The applicator tip 18 is porous to the fluid 6 and can be formed as a foam member using a suitable polymeric (e.g., urethane) open cell foam. It will be seen that the applicator tip 18 extends away from the neck portion 12 and has a central bore 20 in alignment with the orifice 16.

Figure 5:
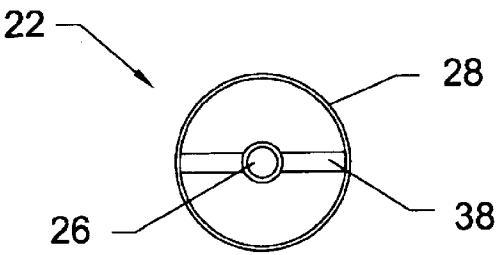
FIG. 5 is a cross-sectional view taken along line 5—5 in FIG. 4.
Figure 4:
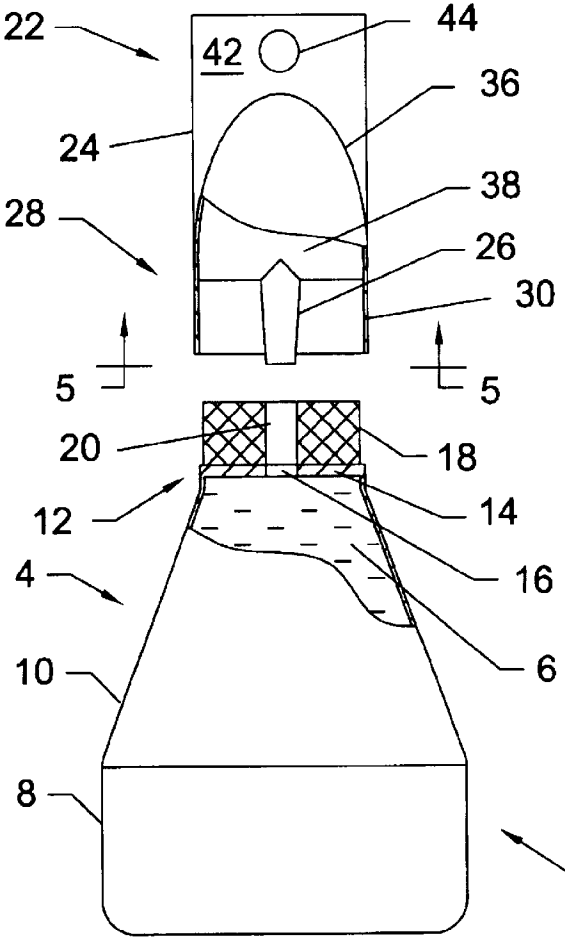
FIG. 4 is an exploded front elevational view showing the assembly of FIG. 1 with the closure cap thereof removed from the applicator's fluid container portion.

With additional reference now to FIGS. 4 and 5, a closure cap 22 has a generally flat, longitudinally oriented handle 24 with a downwardly extending pin 26. The pin 26 fits through the bore 20 and plugs the orifice 16, thereby keeping fluid out of the applicator tip 18 prior to use. The handle 24 can be formed from molded plastic or other suitable material. The closure cap 22 also has a thin-walled shell portion 28. As best shown in FIGS. 1 and 2, a lower section 30 of the shell 28 is formed as a cylindrical-walled structure. It has a height sufficient to cover the applicator tip 18 and part of the neck portion 12 of the container 4, on which the lower section 30 is slidably disposed. Above the applicator tip 18, the lower section 30 is rounded inwardly to define a corner 32, and then merges with an upper section 34 of the shell 28. The upper section 34 is tapered (see FIG. 1) and extends upwardly from the lower section 30 to connect to the handle 24 along a generally arc-shaped interface 36 (see FIGS. 2 and 4). As can be seen in FIGS. 2, 4 and 5, a lower portion 38 of the handle 24 extends downwardly from the interface 36, within the confines of the shell 28, and carries the pin 26 for engagement with the bore 20 and the orifice 16. Alternatively, the lower portion 38 of the handle 24 could be eliminated such that the handle terminates at the interface 36. The pin 26 would then extend downwardly from this interface. According to still another design alternative, the upper section 34 of the shell 28 could be eliminated and the lower section 30 could connect to the handle's lower portion 38, inwardly from the corner 32. Note that the shell 28 can be integrally formed with the handle 24, or it can be separately formed. According to the latter approach, the shell 28 could be constructed from a metallized plastic film or the like that is bonded to the handle 24 along the interface 36.

Insofar as the applicator 2 is designed for single use applications, there is no need to provide threads or other locking connection features between the closure cap 22 and the container 4. The shell 28 and the container neck portion 12 are thus maintained in strictly slideable, non-locking interfacial engagement with each other. As shown in FIG. 1, a conventional tearable plastic strip seal 40 is used to hermetically seal the shell 28 to the container neck portion 12 prior to use of the applicator 2.

Advantageously, the handle 24 of the closure cap 22 is adapted for to facilitate point-of-purchase display of the applicator 2. To that end, the handle 24 is oriented longitudinally (i.e., vertically in FIGS. 1, 2 and 4) and is relatively thin in one dimension (see FIG. 1) and relatively wide in another dimension (see FIGS. 2 and 4). The wide dimension of the handle 24 provides a location 42 for applying a name, trademark or other identifier. The shell 28 of the closure cap 22 may also be used to provide such a location. The handle 24 can be further formed with a hole or other opening 44 (e.g., a slot) so that the applicator 2 can be placed on a display hook or the like. Although not shown, the handle 24 could be formed so as to be wide in more than one dimension, e.g., it could be round, oval, rectangular, triangular, polygonal, etc., when viewed in plan, thereby providing additional display locations.

To use the applicator 2, the strip seal 40 is torn off and the closure cap 22 is removed to pull the pin 26 out of the orifice 16. FIG. 4 illustrates the applicator 2 in its open condition. The container 4 may then be squeezed (or simply inverted) to direct the fluid 6 through the orifice 16 and in to the bore 20, so that the fluid can be applied to the desired surface and spread by the applicator tip 18. Following use, the container 4 and the cap 22 can be discarded.

Figure 6:
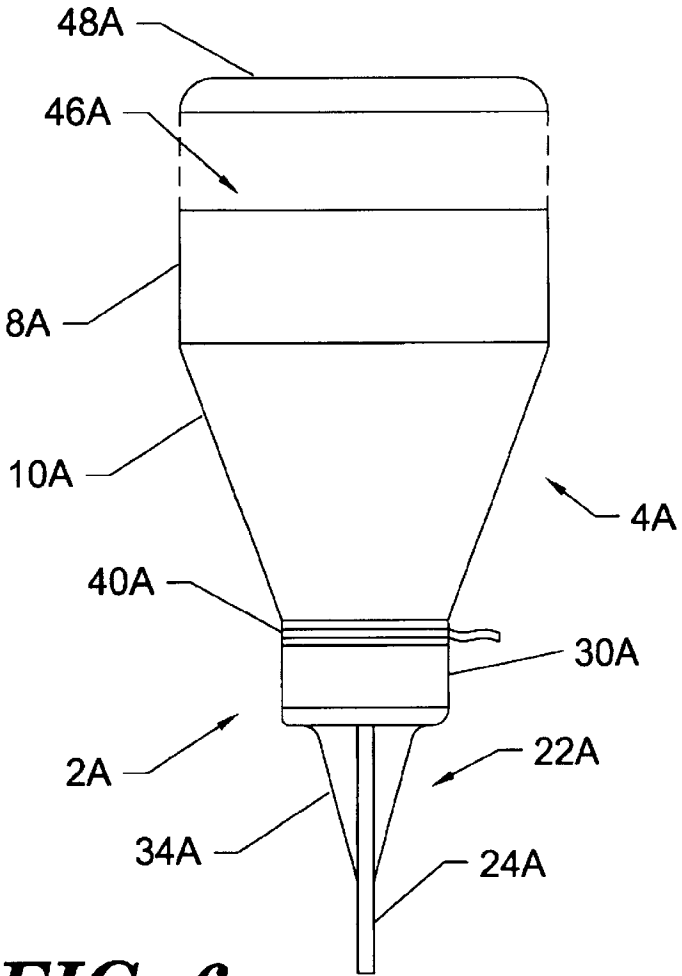
FIG. 6 is a side elevational view showing an applicator and closure cap assembly in accordance with a second embodiment of the invention in which the applicator is not yet charged with a fluid and has an opening adapted to receive such fluid and a closure member to cover the opening.

Turning now to FIG. 6, another embodiment of the invention is illustrated in which a disposable single-use applicator 2A is identical in all respects to the applicator 2 described above (as shown by the use of corresponding reference numerals) except that its container 4A is empty and not yet charged with a fluid. Moreover, the container 4A has its bottom removed to form an opening 46A that is adapted to receive a fluid 6A (see FIG. 7A) to be introduced within the container in a future fluid introduction process. In FIG. 6, the opening 46A is shown to span the entire cross-sectional area of the bottom section 8A of the container 4A. It will be appreciated, however, that the opening 46A could be of any suitable size and situated at any suitable portion of the container 4A. For example, it may be possible to form the opening as a small hole (not shown) that receives a cannula through which the fluid 6A is injected into the container 4A.

Figure 7B:
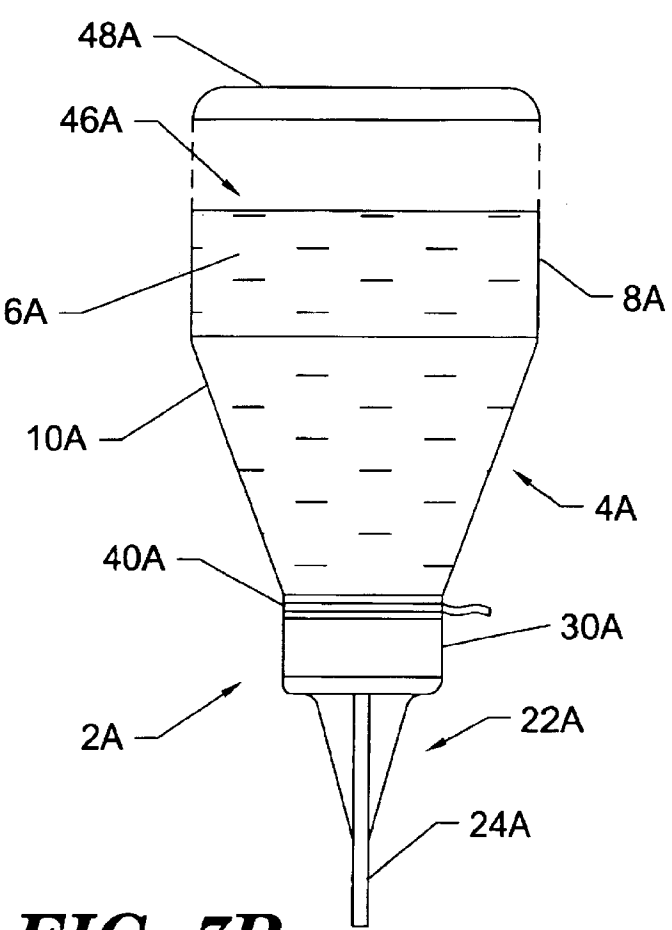
FIG. 7B is a side elevational view of the assembly of FIG. 6 after the applicator is charged with a dispensable fluid and the opening in the applicator is ready to be closed with the closure member.
Figure 7A:
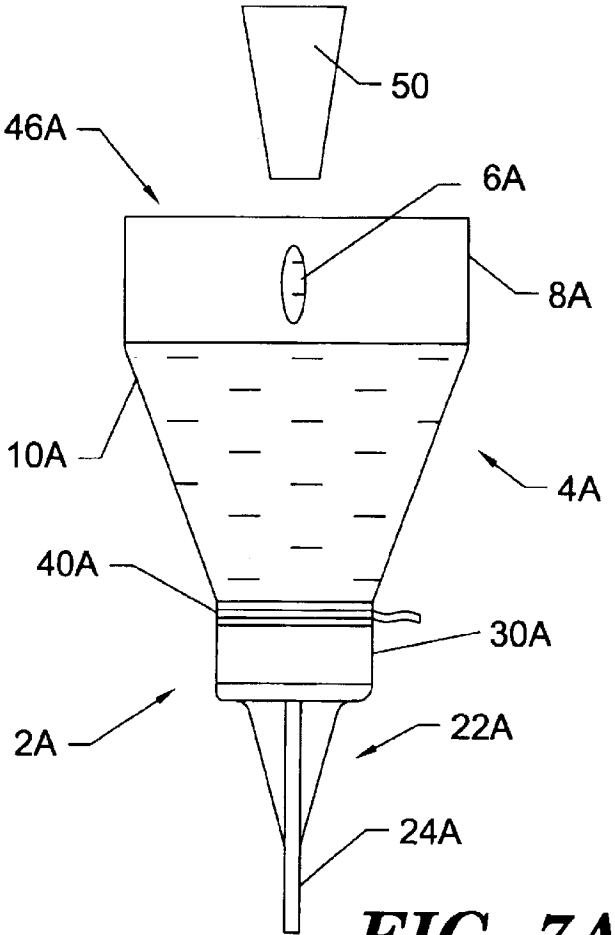
FIG. 7A is a diagrammatic view showing the assembly of FIG. 6 and a system for charging the applicator with a dispensable fluid.

A bottom closure member 48A of the container 4A can be provided with the container for use in the future fluid introduction process. According to this process, and as shown in FIG. 7A, the container 4A is situated below a fluid dispenser 50 and the fluid 6A is dispensed into the container via the opening 46A. As shown in FIG. 7B, when the container 4A is full, the closure member 48A is placed over the opening 46A and hermetically sealed thereto by an appropriate bonding process, such as ultrasonic welding or the like. Note that in cases where the opening 46A is substantially smaller than that shown in FIGS. 6 and 7B, it may be possible to hermetically seal the opening without a closure member, as by applying molten plastic, a sealing agent, etc.

Accordingly an applicator and closure cap assembly have been disclosed. While various embodiments have been shown and described, it should be apparent that many variations and alternative embodiments could be implemented in accordance with the invention. For example, in lieu of using the pin 26 of the closure cap 22 to plug the orifice 16, other suitable closure means could be used to keep fluid out of the applicator tip 18 when the applicator 2 is not in use. Examples include but are not necessarily limited to a conventional spring loaded pin valve that could be associated with the orifice 16. When the valve is closed, the valve pin would plug the orifice 16 and would also extend partially into the region of the applicator tip, which may or may not utilize the central bore 20. When the applicator tip 18 is pressed against a surface, the valve pin would be actuated and biased toward the container's interior. This would unseat the valve pin from the orifice 16 and allow fluid to flow through the orifice. Other valve designs could also be used. It is understood, therefore, that the invention is not to be in any way limited except in accordance with the spirit of the appended claims and their equivalents.

What is claimed is:

1. An applicator and closure cap assembly, comprising:
a container;
fluid in said container;
a neck on said container;
a porous applicator tip secured to said container;
an orifice providing a fluid pathway from a fluid holding portion of said container to said applicator tip;
a closure cap disposed on said neck so as to cover said applicator tip;
a non-locking interface between said closure cap and said neck; and
a removable seal between said closure cap and said neck.

2. An applicator and closure cap assembly in accordance with claim 1 wherein said non-locking interface is a slideable interface.

3. An applicator and closure cap assembly in accordance with claim 1 wherein said seal comprises a tearable hermetic strip seal.

4. An applicator and closure cap assembly in accordance with claim 1 wherein said container comprises a flexible material.

5. An applicator and closure cap assembly in accordance with claim 1 wherein said neck comprises non-tapered side walls and said applicator tip is attached to a structure extending across an opening formed by said neck.

6. An applicator and closure cap assembly in accordance with claim 1 wherein said applicator tip comprises a urethane foam material.

7. An applicator and closure cap assembly in accordance with claim 1 wherein said closure cap comprises an orifice engaging pin engaging said orifice and said applicator tip comprises a central bore in alignment with said orifice for receiving said pin.

8. An applicator and closure cap assembly in accordance with claim 1 wherein said closure cap comprises a handle and a shell portion.

9. An applicator and closure cap assembly in accordance with claim 8 wherein said handle is relatively thin in one dimension and relatively wide in another dimension and includes a location for applying a name, trademark or other identifier.

10. An applicator and closure cap assembly in accordance with claim 8 and wherein said handle includes an opening to facilitate placement of said assembly on a display hook.

11. An applicator and closure cap assembly, comprising:
a container adapted to be filled with a fluid;
an opening in said container to receive a fluid;
a neck on said container;
a porous applicator tip secured to said container;
an orifice providing a fluid pathway from a fluid holding portion of said container to said applicator tip;
a closure cap disposed on said neck to cover said applicator tip;
a non-locking interface between said closure cap and said neck; and
a removable seal between said closure cap and said neck.

12. An applicator and closure cap assembly in accordance with claim 11 wherein said non-locking interface is a slideable interface.

13. An applicator and closure cap assembly in accordance with claim 11 wherein said seal comprises a tearable hermetic strip seal.

14. An applicator and closure cap assembly in accordance with claim 11 wherein said container comprises a flexible material.

15. An applicator and closure cap assembly in accordance with claim 11 wherein said neck comprises non-tapered side walls and said applicator tip is attached to a structure extending across an opening formed by said neck.

16. An applicator and closure cap assembly in accordance with claim 11 wherein said applicator tip comprises a urethane foam material.

17. An applicator and closure cap assembly in accordance with claim 11 wherein said closure cap comprises an orifice engaging pin engaging said orifice and said applicator tip comprises a central bore in alignment with said orifice for receiving said pin.

18. An applicator and closure cap assembly in accordance with claim 11 wherein said closure cap comprises a handle and a shell portion.

19. An applicator and closure cap assembly in accordance with claim 18 wherein said handle is relatively thin in one dimension and relatively wide in another dimension and includes a location for applying a name, trademark or other identifier.

20. An applicator and closure cap assembly in accordance with claim 18 and wherein said handle includes an opening to facilitate placement of said assembly on a display hook.

21. An applicator and closure cap assembly in accordance with claim 11 wherein said container opening is situated at a bottom section of said container and substantially spans a cross-sectional area of said bottom section.

22. An applicator and closure cap assembly in accordance with claim 11 further including a closure member adapted to mount over said container opening when it is desired to seal said container after introducing a fluid therein.

23. A method for producing an applicator and closure cap assembly charged with a dispensable fluid comprising:
selecting an uncharged applicator and closure cap assembly, comprising:
a container adapted to be filled with a fluid;
an opening in said container to receive a fluid;
a neck on said container;
a porous applicator tip secured to said container;
an orifice providing a fluid pathway from a fluid holding portion of said container to said applicator tip;
a closure cap disposed on said neck to cover said applicator tip;
a non-locking interface between said closure cap and said neck; and
a removable seal between said closure cap and said neck;
charging said applicator and closure cap assembly with a dispensable fluid by introducing said fluid into said container via said container opening; and
sealing said container opening.

24. An applicator and closure cap assembly, comprising:
a container;
fluid in said container;
a neck on said container;
a porous applicator tip secured to said container;
an orifice providing a fluid pathway from a fluid holding portion of said container to said applicator tip;
a closure cap disposed on said neck to cover said applicator tip;
a removable seal between said closure cap and said neck; and
said closure cap comprising a longitudinally oriented handle that is relatively thin in one dimension and relatively wide in another dimension and includes a location for applying a name, trademark or other identifier and an opening to facilitate placement of said assembly on a display hook.

25. An applicator and closure cap assembly, comprising:

a container adapted to be filled with a fluid;

an opening in said container to receive a fluid;

a neck on said container;

a porous applicator tip secured to said container;

an orifice providing a fluid pathway from a fluid holding portion of said container to said applicator tip;

a closure cap disposed on said neck to cover said applicator tip;

a removable seal between said closure cap and said neck; and said closure cap comprising a longitudinally oriented handle that is relatively thin in one dimension and relatively wide in another dimension and includes a location for applying a name, trademark or other identifier and an opening to facilitate placement of said assembly on a display hook.

* * * * *